US006268839B1

(12) United States Patent
Yang et al.

(10) Patent No.: US 6,268,839 B1
(45) Date of Patent: Jul. 31, 2001

(54) DRIVE SCHEMES FOR GRAY SCALE BISTABLE CHOLESTERIC REFLECTIVE DISPLAYS

(75) Inventors: Deng-Ke Yang, Hudson; Xiao-Yang Huang, Stow; Nick M. Miller, Atwater, all of OH (US)

(73) Assignee: Kent State University, Kent, OH (US)

( * ) Notice: Subject to any disclaimer, the term of this patent is extended or adjusted under 35 U.S.C. 154(b) by 0 days.

(21) Appl. No.: 09/076,577

(22) Filed: May 12, 1998

(51) Int. Cl.[7] ..... G09G 3/36

(52) U.S. Cl. ..... 345/89; 345/94; 345/87; 349/169; 349/177; 349/33

(58) Field of Search ..... 345/89, 87, 94, 345/97, 96, 99; 349/169, 33, 96, 177, 86

(56) References Cited

U.S. PATENT DOCUMENTS

| | | | | |
|---|---|---|---|---|
| 3,995,942 | * | 12/1976 | Kawakami et al. | 350/160 |
| 4,317,115 | | 2/1982 | Kawakami et al. | 359/55 |
| 4,514,045 | | 4/1985 | Huffman et al. . | |
| 4,626,074 | | 12/1986 | Crossland et al. . | |
| 4,636,788 | | 1/1987 | Hilbrink . | |
| 4,641,135 | | 2/1987 | Hilbrink . | |
| 4,668,049 | | 5/1987 | Canter et al. . | |
| 4,705,345 | | 11/1987 | Ayliffe et al. . | |
| 4,728,175 | | 3/1988 | Baron . | |
| 4,761,058 | | 8/1988 | Okubo et al. . | |
| 4,769,639 | | 9/1988 | Kawamura et al. . | |
| 4,864,538 | | 9/1989 | Buzak . | |
| 4,909,607 | | 3/1990 | Ross . | |
| 4,958,915 | | 9/1990 | Okada et al. . | |
| 5,036,317 | | 7/1991 | Buzak . | |
| 5,132,823 | | 7/1992 | Kamath et al. . | |
| 5,168,378 | | 12/1992 | Black et al. . | |
| 5,168,380 | | 12/1992 | Fergason . | |
| 5,189,535 | | 2/1993 | Mochizuki et al. | 359/55 |
| 5,251,048 | | 10/1993 | Doane et al. . | |
| 5,252,954 | | 10/1993 | Nagata et al. | 345/210 |
| 5,260,699 | | 11/1993 | Lister et al. . | |
| 5,280,280 | | 1/1994 | Hotto . | |
| 5,285,214 | | 2/1994 | Bowry . | |
| 5,289,175 | | 2/1994 | Kawagishi | 359/84 |
| 5,289,300 | | 2/1994 | Yamazaki et al. . | |
| 5,293,261 | | 3/1994 | Shashidhar et al. . | |
| 5,315,101 | | 5/1994 | Hughes et al. . | |
| 5,317,332 | * | 5/1994 | Kanno et al. | 345/101 |
| 5,644,330 | | 7/1997 | Catchpole et al. | 345/95 |
| 5,691,740 | * | 11/1997 | Onitsuka et al. | 345/96 |
| 5,933,203 | * | 8/1999 | Wu et al. | 349/35 |
| 5,986,724 | * | 11/1999 | Akiyama et al. | 349/41 |
| 6,057,817 | * | 5/2000 | Ono et al. | 345/94 |

OTHER PUBLICATIONS

Yu and Kwok, *A New Driving Scheme for Reflective Bistable Cholesteric LCDs*, SID 97 Digest (1997), pp. 659–662.

Huang, Miller, and Doane, *Unipolar Implementation for the Dynamic Drive Scheme of Bistable Reflective Cholesteric Displays*, SID 97 Digest (1997), pp. 899–302.

Kozachenko et al., *Hysteresis as a Key Factor for the Fast Control of Reflectivity in Cholesteric LCDs*, 1997 SID, pp. 148–151.

* cited by examiner

*Primary Examiner*—Bipin Shalwala
*Assistant Examiner*—Jimmy H. Nguyen
(74) *Attorney, Agent, or Firm*—Renner, Kenner, Greive, Bobak, Taylor & Weber

(57) ABSTRACT

A series of drive schemes are used to apply a single phase of at least one voltage pulse to drive a display with a bistable cholesteric liquid crystal material to a gray scale reflectance. Each drive scheme takes into consideration the initial texture of the cholesteric material and the range of voltages that may be applied between maximum and minimum reflectance of the material. Application of the single phase can be implemented by either time modulation or amplitude modulation.

6 Claims, 3 Drawing Sheets

DRIVE SCHEMES FOR GRAY SCALE BISTABLE CHOLESTERIC REFLECTIVE DISPLAYS

GOVERNMENT RIGHTS

The United States Government has a paid-up license in this invention and may have the right in limited circumstances to require the patent owner to license others on reasonable terms as provided for by terms of Contract No. N61331-96C-0042, awarded by the Defense Advanced Research Projects Agency.

TECHNICAL FIELD

The present invention relates generally to drive schemes for liquid crystal displays employing cholesteric, reflective bistable liquid crystal material. In particular, the present invention relates to drive schemes for cholesteric liquid crystal displays that provide gray scale appearance. Specifically, the present invention is directed to drive schemes that utilize a range of voltages to drive a portion of the liquid crystal material to a particular texture and attain the desired gray scale appearance.

BACKGROUND ART

Drive schemes for cholesteric materials are discussed in U.S. patent application Ser. No. 08/852,319, which is incorporated herein by reference. As discussed therein, a gray scale appearance for bistable cholesteric reflective displays is obtained by applying a voltage within a range of voltages during a selection phase, which is one of a series of phases for voltage application pulses, to obtain the desired gray scale appearance. In that disclosed drive scheme, it is only appreciated that the cholesteric material can be driven from a non-reflective focal conic texture to a reflective planar texture. Moreover, when the material is driven from a non-reflective state to a reflective state, no consideration is given to the initial state of the liquid crystal material. In other words, a wide range of voltages is applied to the material, no matter if the material was initially in the focal conic texture or in the twisted planar texture. Accordingly, a wide undefined range of voltage pulses is required to drive the liquid crystal material to obtain a gray scale appearance.

As discussed in U.S. patent application Ser. No. 08/852,319, time modulation of the selection phase voltage may be employed to control the level of gray scale reflectance of the liquid crystal material. However, it has been determined that this method of voltage application may not be suitable for some cholesteric liquid crystal materials.

Based upon the foregoing, it is evident that there is a need in the art for drive schemes which more precisely drive cholesteric liquid crystal material to an appropriate gray scale appearance. Moreover, there is a need in the art to employ a drive scheme which allows for use of inexpensive driving circuitry. There is also a need in the art to provide a time modulation and amplitude modulation voltage application sequence that is adaptable to all cholesteric materials.

DISCLOSURE OF INVENTION

In light of the foregoing, it is a first aspect of the present invention to provide drive schemes of gray scale bistable cholesteric reflective displays.

Another aspect of the present invention is to provide a cholesteric liquid crystal display cell with opposed substrates, wherein one of the substrates has a plurality of row electrodes and the other substrate has a plurality of column electrodes, and wherein the intersections between the row and column electrodes form picture elements or pixels.

Yet another aspect of the present invention, as set forth above, is to provide a plurality of drive schemes, which are a single series of voltage pulses, that are used to drive a liquid crystal material between a non-reflective focal conic texture and a reflecting planar texture with various levels of reflectance therebetween depending upon the voltage values applied to the row and column electrodes.

A further aspect of the present invention, as set forth above, is to provide a drive scheme in which the liquid crystal material is initially driven to a reflective planar texture and wherein a predetermined range of voltages drives the liquid crystal material from the planar texture to the focal conic texture to exhibit gray scale reflectance properties.

Yet a further aspect of the present invention, as set forth above, is to provide a drive scheme in which all of the liquid crystal material is initially driven to a non-reflective focal conic texture and wherein a predetermined range of voltages drives the liquid crystal material from the focal conic texture to the planar texture to exhibit gray scale reflectance properties.

Yet an additional aspect of the present invention, as set forth above, is to provide a drive scheme in which all of the liquid crystal material is initially driven to a reflective planar texture and wherein a predetermined range of voltages drives the liquid crystal material from the planar texture to a focal conic texture to exhibit the desired incremental gray scale reflectance properties.

Still another aspect of the present invention, as set forth above, is to employ a time modulation technique to the applied voltage pulses to drive the cholesteric liquid crystal material to the desired gray scale reflectance.

Still another aspect of the present invention, as set forth above, is to employ an amplitude modulation drive technique to drive the cholesteric liquid crystal material to the desired gray scale reflectance.

The foregoing and other aspects of the present invention which shall become apparent as the detailed description proceeds are achieved by a method of addressing a bistable liquid crystal material having incremental reflectance properties disposed between opposed substrates, wherein one substrate has a first plurality of electrodes disposed in a first direction facing the other substrate which has a second plurality of electrodes disposed in a direction orthogonal to the first direction, the intersections thereof forming a plurality of pixels, the method comprising the steps of energizing the first and second plurality of electrodes to drive all the liquid crystal material to one of the first plurality of electrodes to a gray voltage value which is between first and second characteristic voltage values and the second plurality of electrodes to a second voltage value, wherein the second voltage value is between the difference between the gray voltage value and the first characteristic voltage value and the difference between the gray voltage value and the second characteristic voltage value, and wherein the difference between the first and the second voltage values generates a pixel voltage value, wherein if the pixel voltage value is between the first characteristic voltage value associated with minimum reflectance, the liquid crystal material between the first and second plurality of electrodes exhibits an incremental reflectance between the minimum and maximum reflectance.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
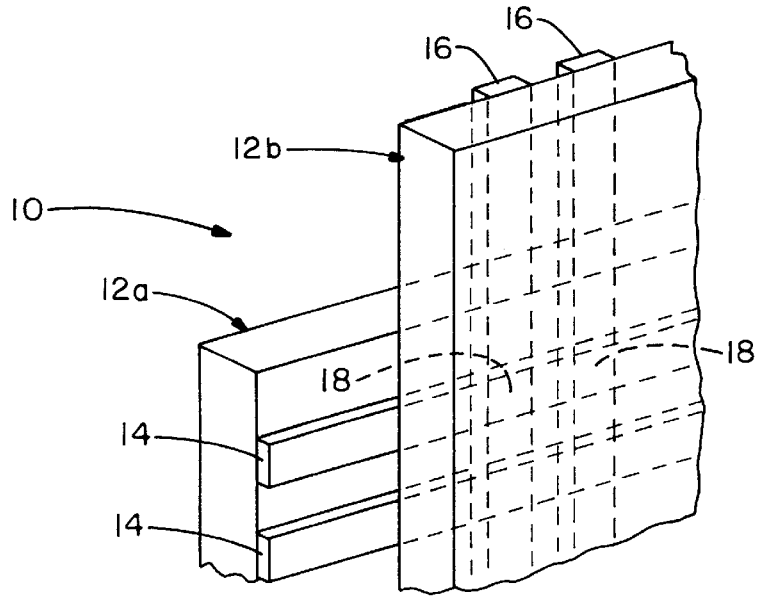
FIG. 1 is a perspective schematic representation of a liquid crystal display using row and column electrodes.

Referring now to the drawings and in particular to FIG. 1, it can be seen that a liquid crystal display, according to the present invention is designated generally by the numeral 10. The display 10 includes opposed substrates 12*a* and 12*b* which may be either glass or plastic materials that are optically clear in appearance. In the present embodiment, a bistable cholesteric liquid crystal material is disposed between the opposed substrates 12 in a manner well-known in the art. The cholesteric material exhibits gray scale properties depending upon a voltage value applied to the liquid crystal material. In particular, one of the opposed substrates 12*a* includes a plurality of row electrodes 14 facing the opposite substrate 12*b*. Likewise, the other opposed substrate 12*b* provides a plurality of column electrodes 16 which face the opposed substrate 12*a*. By orthogonally orienting the electrodes 14 and 16, a plurality of pixels 18 are formed at the intersections thereof across the entire surface of the liquid crystal display 10. Each of the pixels 18 may be individually addressed so as to generate some type of indicia on the liquid crystal display 10. As will become apparent from the following description, each row electrode 14 and column electrode 16 is addressed by processor controlled electronics (not shown) to a range of voltage values that drive the cholesteric liquid crystal material to a desired gray scale reflectance or appearance.

Figure 2:
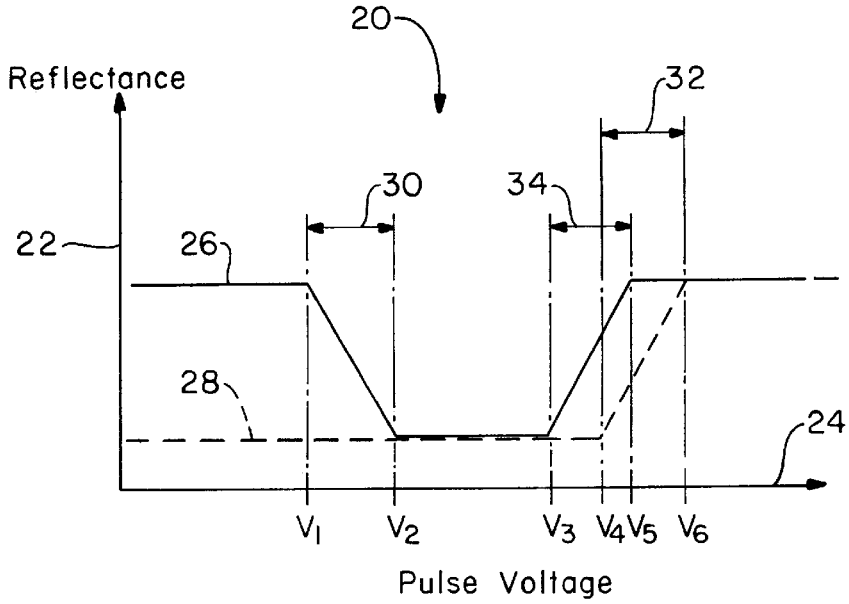
FIG. 2 is a schematic representation of the response of a cholesteric material to voltage pulses and their respective drive schemes according to the present invention.

Referring now to FIG. 2, it can be seen that a plurality of drive schemes according to the present invention, are designated generally by the numeral 20. FIG. 2 provides a schematic representation of the drive schemes 20 wherein characteristic voltage values ($V_1 \ldots V_6$) are provided along the x-axis and reflectance values are provided along the y-axis. It is understood that these characteristic voltage values depend on the cholesteric material and the width of the applied voltage pulses. Accordingly, depending upon a voltage applied to the row electrodes 14 and the column electrodes 16, the cholesteric liquid crystal material associated with each pixel 18 is adjusted or driven accordingly.

FIG. 2 shows the response of a cholesteric material when a single series of voltage pulses is applied. The reflectance is measured at a time sufficiently long after the applied voltage pulse. The values of the voltages depend on the particular cholesteric material, display cell design, and the time interval of the applied voltage pulse. All voltage values discussed herein are rms voltages.

A curve 26 represents when the cholesteric material is initially disposed in a reflective planar texture and is driven therefrom to a focal conic texture and, if desired, back to a planar texture. A curve 28 represents when the cholesteric material is initially disposed in a focal conic texture and is driven to a reflecting planar texture. By utilizing the transitional aspects of the curves 26 and 28 between different applied characteristic voltage values, the cholesteric material exhibits gray scale properties.

The curve 26 includes a drive scheme 30. To implement the drive scheme 30, the display 10 is first freshed to the planar texture by applying a voltage pulse having a value higher than the characteristic voltage $V_6$. All the pixels 18 are switched to the planar texture after the pulse. The display 10 is then addressed to show a gray scale image.

The scheme 30 is the region between characteristic voltage $V_1$ and $V_2$ of the curve 26. To obtain a gray scale appearance, voltages are applied to both the row and column electrodes. A row on voltage ($V_{ron}$) is applied to at least one of the row electrodes, wherein $V_{ron}V_o+V_i$. $V_o$ is an offset voltage value used for schemes 30, 32, and 34 which may be 0 volts or any voltage value which is compatible with the drive electronics for the purpose of efficiently obtaining the gray scale image. $V_i$ is the "gray" voltage value which is somewhere between characteristic voltages $V_1$ and $V_2$. In the scheme 30, any voltage value that is less than or equal to $V_1$ is considered to be an "on" voltage value. Any voltage value that is greater than or equal to $V_2$ is considered to be an "off" voltage value. Simultaneous with the application of $V_{ron}$, $V_{column}$ is applied to the column electrodes 16. In particular, a voltage pixel value $V_{pixel}$ is obtained by the difference between $V_{row}$ and $V_{column}$. Accordingly, the column voltage $V_{column}$ may take a value between $V_{coff}=V_o+V_i-V_2$ and $V_{con}=V_o+V_i-V_1$. Therefore, if the column voltage is $V_{coff}$, the voltage across the pixel ($V_{pixel}$) is $[V_o+V_i]-[V_o+V_i-V_2]=V_2$. As such, the pixel is addressed to the focal conic texture with minimum reflectance. If the column voltage is $V_{con}$, $V_{pixel}$ is $[V_o+V_i]-V_o+V_i-V_1]=V_1$. Accordingly, the pixel is addressed to the planar texture with the maximum reflectance. In order to obtain a gray pixel reflectance value between the reflecting planar and the non-reflecting focal conic textures, a column voltage value between $V_{coff}$ and $V_{con}$ is applied to the column electrodes 16 while the row electrode 14 is addressed to a value of $V_{ron}$. Accordingly, the pixel 18 consists of planar texture domains and focal conic texture domains to exhibit a gray scale reflectance.

In the event the row electrode 14 is off or not addressed, the electrode row voltage is $V_{roff}=V_{coff}=V_o$. Accordingly, the appearance of the cholesteric material remains in its original texture until such time that the row electrode is addressed.

The amplitude of the voltage across the pixels 18 on the rows not being addressed is less than or equal to a voltage value $V_{cross}$. In the event $|V_i-V_2| \leqq V_i-V_1|$, then $V_{cross}=|V_i-V_1|$. In the event that $|V_i-V_2|$ is larger than $|V_i-V_1|$, then $V_{cross}=|V_i-V_2|$. It will be appreciated that to properly drive the cholesteric material in the display 10, the value of $V_{cross}$ must be less than or equal to avoid cross-talking problems.

Those skilled in the art will appreciate that the nominal choice for a pixel being addressed is where $V_i$ is equal to 0.5 $(V_2+V_1)$ wherein $V_{coff}=V_o=0.5\ (V_2-V_1)$ and $V_{con}=V_o-0.5\ (V_2-V_1)$. Likewise, the voltage across a pixel not being addressed is minimized to 0.5 $(V_2-V_1)$. By adjusting $V_{column}$ between $V_{coff}$ and $V_{con}$, incremental gray scale reflectances can be obtained for the liquid crystal display 10.

The advantage of the scheme 30 is that the row voltage can be maintained at a relatively low value, thus minimizing the costs of the electronics and processing software required to drive the liquid crystal display 10.

The curve 28 includes a drive scheme 32. To implement the scheme 32, all of the pixels 18 of the display 10 are freshed to the focal conic texture by applying a voltage value between $V_2$ and $V_3$. The scheme 32 is the region between $V_4$ and $V_6$. In this scheme, $V_i$ is somewhere between characteristic voltage values $V_4$ and $V_6$. In the scheme 32, any voltage value that is less than or equal or $V_4$ is considered to be an "off" voltage value. Any voltage value that is greater then or equal to $V_6$ is considered to be an "on" voltage value. As in the previous scheme, the voltage pixel value $V_{pixel}$ is obtained by the difference of $V_{row}$ and $V_{column}$. Accordingly, the column voltage $V_{column}$ takes a value between $V_{coff}=V_o+V_i-V_4$ and $V_{con}=V_o+V_i-V_6$. Therefore, if the column voltage is $V_{coff}$, the voltage across the pixel, $V_{pixel}$, is $[V_o+V_i]-V_o+V_i-V_4]=V_4$. As such, the pixel is addressed to the focal conic texture with the minimum reflectance. If the column voltage is $V_{coff}$, the voltage is $V_{con}$, the pixel voltage is $|V_o+V_i]-V_o+V_i-V_6]=V_6$ and the pixel is addressed to the planar texture with the maximum reflectance. In order to obtain a gray scale reflectance value between the non-reflective focal conic texture and the reflecting planar texture, a column voltage between $V_{coff}$ and $V_{con}$ is applied to the column electrodes 16 while the row electrode 14 is addressed. Accordingly, the pixel 18 consists of focal conic texture domains and planar texture domains to exhibit a gray scale reflectance.

If the row electrode 14 is not being addressed, the row electrode voltage is $V_{roff}=V_{coff}=V_o$. Accordingly, the appearance of the cholesteric material associated with a particular row remains in its original texture until such time that the row electrode is addressed.

The amplitude of the voltage across the pixels 18 on the row not being addressed is less than or equal to $V_{cross}$. In the event $|V_i-V_4|\leqq|V_i-V_6|$, then $V_{cross}=|V_i-V_6|$. In the event that $|V_i-V_4|$ is larger than $|V_i-V_6|$, then $V_{cross}=|V_i-V_4|$. It will be appreciated that to properly drive the cholesteric material in the display 10, the value of $V_{cross}$ must be less than or equal to $V_1$ in order to avoid cross-talking problems.

Those skilled in the art will appreciate that the nominal choice of $V_i$ is the equal to 0.5 $(V_6+V_4)$ wherein $V_{con}=V_{con}=V_o-0.5(V_6-V_4)$ and $V_{coff}=V_o+0.5\ (V_6-V_4)$. Likewise, the voltage across a pixel not being addressed is minimized to 0.5 $(V_6-V_4)$. By adjusting the value of $V_{column}$ between $V_{coff}$ and $V_{con}$, incremental gray scale reflectances can be obtained for the liquid crystal display 10. The advantage of the scheme 32 is that the addressing speed can be increased by using a higher addressing voltage.

The curve 26 also includes a second drive scheme 34. To implement the scheme 34, all the pixels 18 are freshed to the planar texture after application of a voltage pulse higher than $V_6$. The scheme 34 is the region between $V_3$ and $V_5$ of the curve 26. In this scheme, $V_1$ is somewhere between characteristic voltage values $V_3$ and $V_5$. In the scheme 34, any voltage value that is less than or equal to $V_3$ is considered to be an "off" voltage value. Any voltage value that is greater than or equal to $V_5$ is considered to be an "off" voltage value. As in the previous schemes, the voltage pixel value $V_{pixel}$ is obtained by the difference of $V_{row}$ and $V_{column}$. Accordingly, the column voltage $V_{column}$ takes a value between $V_{coff}=V_o+V_i-V_3$ and $V_{con}=V_o+V_i-V_5$. Therefore, if the column is $V_{coff}$, the voltage across the pixel, $V_{pixel}$ is $[V_o+V_i]-[V_o+V_i-V_3]=V_3$. As such, the pixel is addressed to the focal conic texture with the minimum reflectance. If the column voltage is $V_{con}$, the pixel voltage is $[V_o+V_i]-[V_o+V_i-V_5]=V_5$ and the pixel is addressed to the planar texture with the maximum reflectance. In order to obtain the gray scale reflectances between the reflecting planar texture and the non-reflecting focal conic texture, a column voltage between $V_{coff}$ and $V_{con}$ is applied to the column electrode 16 while the row electrode 14 is being addressed. Accordingly, the pixel 18 consists of planar texture domains and focal conic texture domains to exhibit a gray scale reflectance.

If the row electrode 14 is not being addressed, the row electrode voltage is $V_{coff}=V_o$. Accordingly, the appearance of the cholesteric material remains in its original texture until such time that the row electrode is addressed.

The amplitude of the voltage across the pixels 18 on the row not being addressed is less than or equal to $V_{cross}$. In the event $|V_i-V_3|\leqq|V_i-V_5|$, then $V_{cross}=|V_i-V_5|$. In the event that $|V_i-V_3|$ is larger than $|V_i-V_5|$, then $V_{cross}=|V_i-V_5|$. It will be appreciated that to properly drive the cholesteric material in the display 10, the value of $V_{cross}$ must be less than or equal to $V_3$ in order to avoid cross-talking problems.

Those skilled in the art will appreciated that the nominal choice of $V_i$ is equal to 0.5 $(V_5+V_3)$ wherein $V_{con}=V_o-0.5\ (V_5-V_3)$ and $V_{coff}=V_o+0.5\ (V_5-V_3)$. By adjusting the value of $V_{con}=V_o-0.5\ (V_5-V_3)$ and $V_{coff}=V_o+0.5\ (V_5-V_3)$, incremental gray scale reflectances can be obtained for the liquid crystal display 10.

The advantage of the scheme 34 is that the row voltage can be maintained at a relatively low value, thus minimizing the costs of the electronics and processing software required to drive the liquid crystal display 10.

Referring now to FIGS. 3 and 4, it can be seen that the column voltages for obtaining relatively low value, thus minimizing the costs of the electronics and processing software required to drive the liquid crystal display 10.

Referring now to FIGS. 3 and 4, it can be seen that the column voltages for obtaining gray scale reflectances may be implemented by using either time modulation or amplitude modulation driving schemes.

Figure 3A:
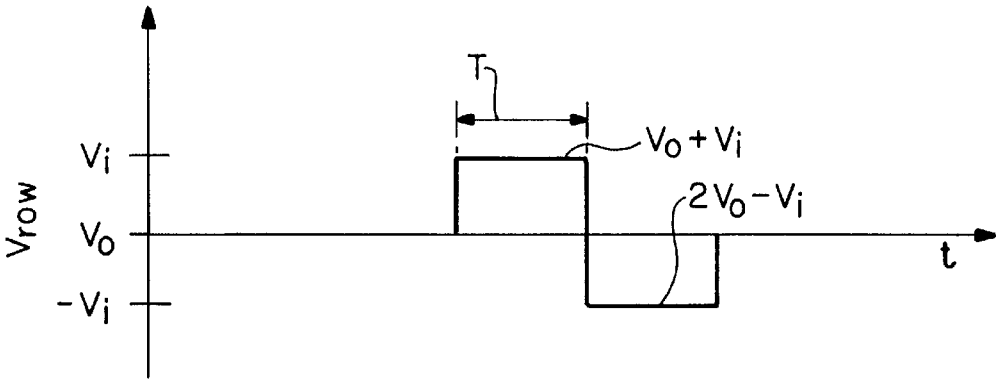
FIGS. 3A–C are graphical representations of a time modulation technique for driving the liquid crystal material.
Figure 3B:
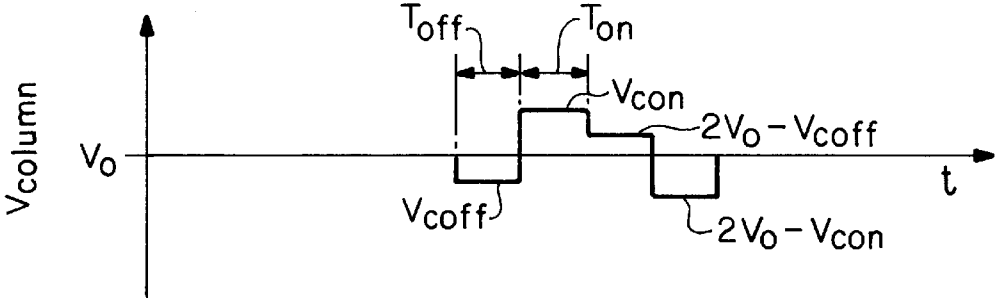
Figure 3C:
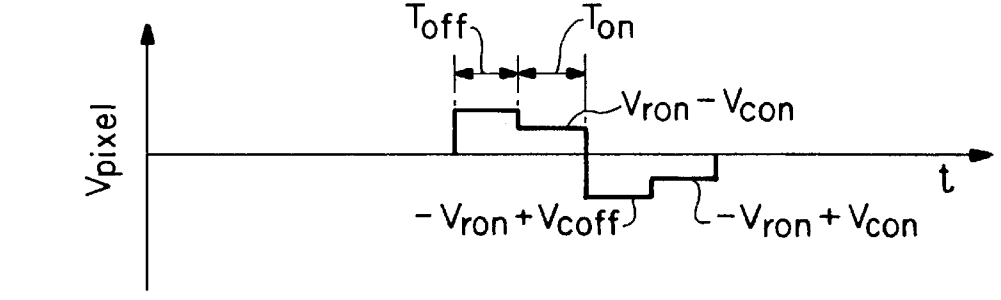

As best seen in FIGS. 3A–C, when the row electrodes 14 are addressed, the on voltage value $V_i$ is applied to the row electrode 14. The row voltage pulse shown in FIG. 3A has a width T which represents a predetermined period of time. During this time period T, the column voltage $V_{column}$, consists of two pulses. In the first pulse, the voltage is $V_{coff}$ and the time integral is $T_{off}$. During the second pulse, the voltage applied to the column electrode 16 is $V_{con}$ and the time interval is $T_{on}=T-T_{off}$. As those skilled in the art will appreciate, the $T_{off}$ time period is adjusted to obtain the desired gray scale reflectance value of the pixel 18. In the event that $T_{off}=T$, the pixel is addressed to the off-state or placed in the focal conic texture. When $T_{off}=0$, the pixel 18 is addressed to the on-state or the reflecting planar texture. Accordingly, to obtain the desired gray scale reflectance value, $T_{off}$ is selected to be a time period somewhere between 0 and the value T. Thus, the number of pulses to address one pixel could be one pulse or a plurality of pulses. It will also be appreciated that the waveform of the pules could be a square wave or other well-known waveform.

During the first time period T, using the scheme 30 as an example, the row voltage is equal to $V_o+V_i$. Simultaneously, the column voltage $V_{coff}$ is equal to $V_o+V_i-V_2$. Accordingly, the voltage value across the pixel is equal to the $V_2$ and the pixel is placed in the focal conic texture. During the time period $T_{on}$, the column electrode 16 is energized to $V_{con}$ and the pixel voltage value is equal to $V_{ron}-V_{con}$. In other words, $V_{pixel}=V_oV_i=(V_o+V_i-V_i)$, which in turn equals $V_1$. This of course places the pixel 18 in the reflective planar texture. Accordingly, by adjusting the time period that the $V_{con}$ is applied to the column electrode 16, the gray scale reflectance of the pixel 18 is controlled. The second time period T shown in FIGS. 3A–C illustrates when the waveform is inverted and $V_{row}=V_o-V_i$. Likewise, the $V_{column}$ values are inverted which result in a corresponding control of the gray scale appearance of pixel 18. As seen in FIG. 3B, the inverted column voltages yield a corresponding $V_{pixel}$ result by utilizing a value of 2 $V_o-V_{coff}$ when the column voltage value is 2 $V_o-V_i$. When the column electrode is energized, the inverted column voltage is equivalent to a value of 2 $V_o-V_{con}$. In any event, for second time period T, the first pulse is equal to $-V_{ron}+V_{coff}$ and the second pulse is equal to $-V_{ron}-V_{con}$.

Figure 4A:
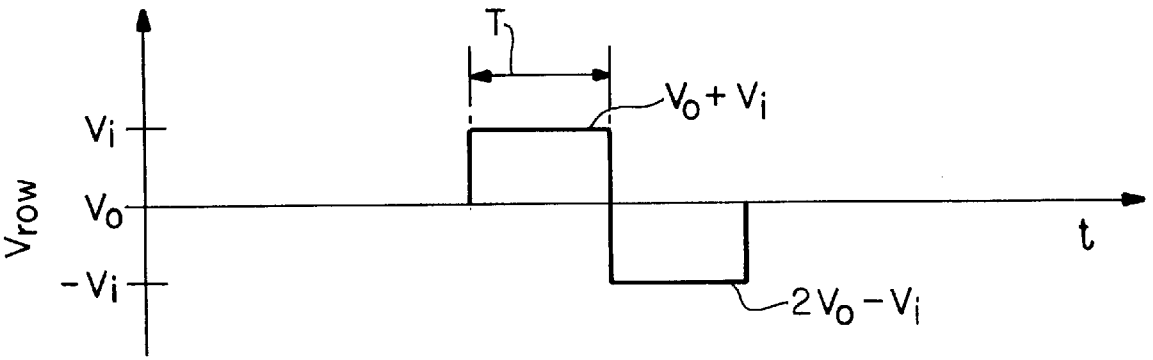
FIGS. 4A–C are graphical representations of an amplitude modulation technique for driving the liquid crystal material.
Figure 4B:
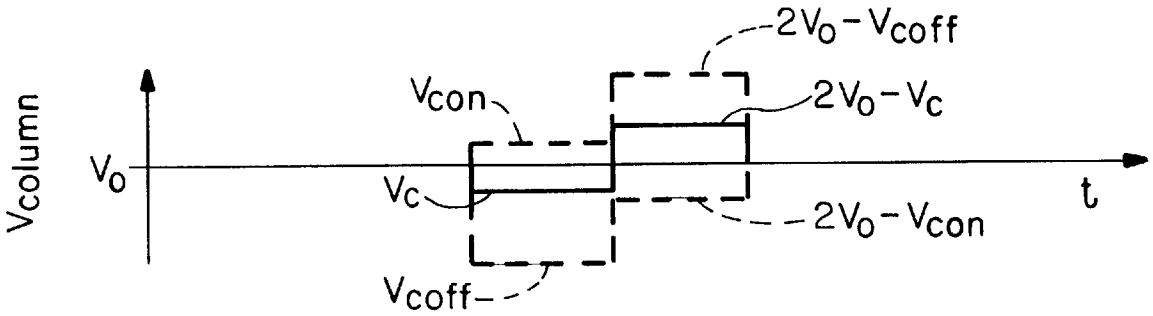
Figure 4C:
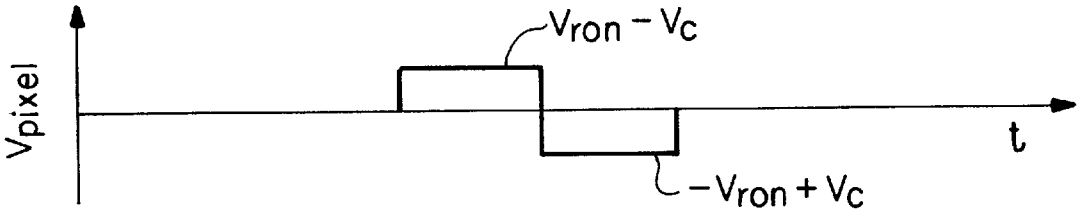

Referring now to FIGS. 4A–C, it can be seen that the gray scale reflectance values may also be adjusted by controlling the amplitude of the column voltage during the first time period T. Accordingly, as seen in FIG. 4B, when the $V_c=V_{con}$, the pixel 18 is addressed to the on-state or reflecting planar texture. In the event $V_c=V_{coff}$, the pixel 18 is addressed to the off-state or the non-reflective focal conic texture. Accordingly, when a gray scale reflectance value is desired, the voltage value $V_c$ is somewhere between $V_{coff}$ and $V_{con}$. In other words, $V_{coff}<V_c<V_{con}$, in the case of $V_{coff}<V_{con}$. Alternatively, $V_{con}<V_c<V_{coff}$, when $V_{con}<V_{coff}$. In either case, the pixel is addressed to a state with a planar texture domains and focal conic domains to generate a gray scale reflectance.

As seen in FIGS. 4A and 4B, during a second time period T, the row voltage is changed to 2 $V_o-V_i$ and the column is changed to 2 $V_o-V_c$. The resulting $V_{pixel}$ value is equivalent to 2 $V_o-V_i-(2\ V_o-V_c)$, which is equal to $V_c-V_i$. As in the time modulation technique, the waveform of $V_{ron}$, $V_{con}$ and $V_{coff}$ could be square or some other type of waveform.

Based upon the foregoing discussion of the drive schemes and their modulation techniques, several advantages are readily apparent. Primarily, gray scale reflectances may be obtained by applying just a single voltage phase of a single or multiple pulses to the cholesteric material whereas previous drive schemes require application of multiple phases. Moreover, by recognizing that the initial texture of the cholesteric material is an important factor in driving the cholesteric material, it will be appreciated that several transitional schemes or regions may be taken advantage of. In particular, when the cholesteric material is initially freshed to the planar texture, transitions of the liquid crystal material between the planar to the focal conic texture and then from the focal conic to the planar texture may be taken advantage of. Likewise, when the cholesteric material is initially freshed to a focal conic texture, transition of the liquid crystal material from the planar texture to the focal conic texture may be taken advantage of so as to obtain the desired gray scale reflectance. These schemes also simplify the use of control electronics by virtue of the time modulation and amplitude modulation techniques provided.

In view of the foregoing, it should thus be evident that a drive scheme for gray scale bistable cholesteric reflective displays as described herein accomplishes the objects of the present invention and otherwise substantially improves the art.

What is claimed is:

1. A method of addressing a bistable cholesteric liquid crystal material having incremental reflectance properties disposed between opposed substrates, wherein one substrate has a first plurality of electrodes deposited thereon facing the other substrate which has a second plurality of electrodes deposited thereon, the intersections of the first and second plurality of electrodes forming a plurality of pixels, the method comprising the steps of:

selecting first and second characteristic voltage values, wherein one of said characteristic voltage values drive the material to a minimum reflectance and the other of said characteristic voltage values drives the materials to a maximum reflectance;

energizing the first and second plurality of electrodes to drive all the liquid crystal material to one of the maximum and minimum reflectances; and energizing the first and second plurality of electrodes to obtain a pixel voltage waveform so as to switch the liquid crystal material to a corresponding incremental reflectance somewhere between the reflectance obtained by application of said first and second characteristic voltage values, wherein application of a portion of said pixel voltage waveform to at least one of said plurality of electrodes is varied to vary said pixel voltage waveform between said first and second characteristic voltages to obtain a corresponding incremental reflectance of the liquid crystal material, wherein obtaining said pixel voltage waveform includes time modulating application of said portion of said pixel voltage waveform in the form of a single bi-level pulse having a first voltage level for a first variable period of time and a second voltage level, different than said first voltage level, for a second variable period of time, wherein the sum of said first and second variable periods of time are equal to a set time period.

2. The method of addressing according to claim 1, further comprising the step of:

applying an offset voltage to both the first and second plurality of electrodes.

3. The method of addressing according to claim 2, wherein the steps of energizing the first and second plurality of electrodes include the step of:

applying a fresh voltage to drive the liquid crystal material to a planar texture, wherein application of said first characteristic voltage value maintains the planar texture, and wherein application of said second characteristic voltage value drives the liquid crystal material to focal conic texture.

4. The method of addressing according to claim 2, wherein the steps of energizing the first and second plurality of electrodes include the step of:

applying a fresh voltage to drive the liquid crystal material to a focal conic texture, wherein application of said first characteristic voltage value maintains the focal conic texture, and wherein application of said second characteristic voltage value drives the liquid crystal material to a planar texture.

5. The method of addressing according to claim 2, wherein the steps of energizing the first and second plurality of electrodes include the step of:

applying a fresh voltage to drive the liquid crystal material to a planar texture wherein application of said second characteristic voltage value maintains the planar texture, and wherein application of said first characteristic voltage value drives the liquid crystal material to focal conic texture.

6. The method of addressing according to claim 1, further comprising:

repeating said time modulating application with an inverted form of said single bi-level pulse.

* * * * *